US007658566B2

(12) United States Patent
Wangler

(10) Patent No.: US 7,658,566 B2
(45) Date of Patent: Feb. 9, 2010

(54) CORN BUTTERER

(75) Inventor: Eric J. Wangler, Orchard Park, NY (US)

(73) Assignee: Mary P. Crowley-Wangler, Mendon, NY (US), part interest ( * ) Notice: Subject to any disclaimer, the term of this patent is extended or adjusted under 35 U.S.C. 154(b) by 696 days.

(21) Appl. No.: 11/370,340

(22) Filed: Mar. 8, 2006

(65) Prior Publication Data

US 2007/0212155 A1 Sep. 13, 2007

(51) Int. Cl.
*A46B 15/00* (2006.01)
*A46B 11/00* (2006.01)

(52) U.S. Cl. ..... 401/12; 401/11; 401/9

(58) Field of Classification Search ..... 401/11, 401/12, 16–18, 25, 82, 84, 176, 261, 263, 401/9, 177; 222/386, 142.1–142.9
See application file for complete search history.

(56) References Cited

U.S. PATENT DOCUMENTS

| | | | | | |
|---|---|---|---|---|---|
| 1,077,459 | A | * | 11/1913 | Driscoll | 222/142.8 |
| 2,101,075 | A | * | 12/1937 | Krag | 222/386 |
| 2,458,120 | A | | 1/1949 | Volpini | |
| 2,581,745 | A | | 1/1952 | Amorino et al. | |
| 2,811,844 | A | * | 11/1957 | Selmer | 118/13 |
| 2,845,707 | A | * | 8/1958 | Redmond | 222/390 |
| 3,162,884 | A | * | 12/1964 | Bordwine et al. | 401/12 |
| 3,178,076 | A | * | 4/1965 | Kennedy | 222/391 |
| D217,007 | S | * | 3/1970 | Smith | D7/670 |
| 3,669,063 | A | | 6/1972 | Daniluke | |
| 3,735,487 | A | * | 5/1973 | Wojcik | 30/124 |
| 3,920,156 | A | * | 11/1975 | Hicks | 222/80 |
| 4,408,919 | A | * | 10/1983 | Wolff et al. | 401/12 |
| 4,804,102 | A | * | 2/1989 | Morris | 222/386 |
| 4,804,113 | A | * | 2/1989 | Ciaccio | 222/142.1 |
| 4,964,745 | A | * | 10/1990 | Deitz | 401/131 |
| 4,981,041 | A | * | 1/1991 | Merkle | 73/426 |
| 5,421,663 | A | * | 6/1995 | Bravo | 401/82 |
| 5,833,382 | A | | 11/1998 | Jenks et al. | |
| 5,971,184 | A | * | 10/1999 | Krishnakumar et al. | 215/384 |
| 6,932,530 | B1 | * | 8/2005 | Bissel | 401/11 |
| 7,037,094 | B1 | * | 5/2006 | Lee | 425/12 |

OTHER PUBLICATIONS

Gadgeteer Corn Butterer, date unknown.

* cited by examiner

*Primary Examiner*—David J. Walczak
*Assistant Examiner*—Keegan Gumbs
(74) *Attorney, Agent, or Firm*—John C. McMahon

(57) ABSTRACT

A butterer for dispensing butter to hot corn on the cob. The butterer includes a two part body that is adapted to be disassembled for cleaning and a central channel for receiving butter. The body also removably receives salt and pepper dispensers. The body is ovate in cross section and shaped to conform to the hand of a user. A pusher is positioned over the butter in the channel and allows a user to urge butter through the channel. A lower grill resists direct contact of semisolid butter with the corn, but transfers heat from the corn and allows melted butter to pass to the corn. A stand and storage tray supports the butterer during non use and allows storage with butter therein in a refrigerator.

17 Claims, 2 Drawing Sheets

CORN BUTTERER

BACKGROUND OF THE INVENTION

An apparatus for use in applying butter from a stick of semi solid butter to hot corn on the cob.

A favorite course at many meals, especially during certain summer months and among those who have home vegetable gardens, is corn on the cob, fresh from a boiling pan. Such corn is best when just picked before sugar content therein converts to starch. Most of those who like such corn, also like to apply butter and often salt and pepper.

Further, those who like buttered corn on the cob have partaken in the process of trying to apply butter from a knife to the corn. Because the butter applies best when melted on the corn, the pad of butter on the knife heats and becomes slidable along the knife, so it is very difficult to control and often falls from the knife. Some users even try to butter the corn by applying the cob directly to butter in a dish which both makes a mess and contaminates the butter.

Prior art devices have been made in an attempt to make a device that effectively applies the butter, but such often contaminate the butter, are difficult to clean, do not lend themselves to storage with butter therein, are likely to make a mess at the table and are often allow the butter as stick to slip from either end of the device without control.

Consequently, applicant has developed a butterer to overcome these obstacles that is easily held and very user friendly. Further, applicant has developed such a butterer that includes insertable salt and pepper shakers that are easily removed for cleaning and a support and storage tray for holding the butterer when not in use.

SUMMARY OF THE INVENTION

A corn butterer includes a body that is ovate in cross section and designed to conform to the palm of the hand of a user during use, preferably being about three inches in height and being about two and a half by one and a half inches in width. The body includes a central channel that extends between a top and a bottom of the body and is sized and shaped to snugly but slidingly receive a stick or partial stick of butter therein, preferably being about one and three eights inches square.

The body is preferably in two parts and has first and second sections that interferingly fit together, but which can be easily disassembled to allow removal of leftover butter and to clean the channel. A bottom cap or keeper includes a side wall that interferingly fits over and surrounds the body sections to help hold the body together.

A pusher is provided that is shaped to be slidingly received in the channel and be used to push the butter through the channel. Preferably the pusher includes a field of pegs on a lower end thereof to engage and become implanted in the butter. The pusher also includes a surrounding seal to seal between the pusher and the channel to resist the flow of melted butter toward the top of the channel.

Also, preferably, the pusher has at least one rib and the channel a series of mating resistance including structures spaced along the length thereof. The pusher and channel resistance structures interferingly resist movement of the pusher along the channel, but can easily be overcome by a user applying pressure to the top of the pusher. The cooperation of the resistance structures help resist accidental slippage of the pusher and butter from the channel when the butterer is turned over during usage.

The body also includes a pair of receivers on opposite sides of the channel that receive removable salt and pepper dispensers. The dispensers include a hinged lid to allow for filling that has a latch for securing and includes dispensing openings. The dispensers can be easily removed to allow cleaning of the remainder of the butterer in water.

The bottom cap operably functions in cooperation with a grill to hold the grill over the bottom end of channel. The grill is preferably constructed of a high heat transfer material most preferably stainless steel and is curvate to conform to the shape of an ear of corn.

The cap has a lower wall that is also shaped to follow the curvature of an ear of corn and has a central window above which the grill is located. The grill has apertures or openings therein that are sized sufficiently small to resist passage of semisolid butter, but allow flow of liquid butter therethrough.

A support and storage device or tray is also provided for the butter. The storage tray has a generally flat bottom and upstanding sides that are sized and shaped to surround and snugly, but slidingly receive a lower end of the body. The storage tray receives the body during non use on the table to prevent dripping of butter onto unwanted areas and can be used to store the butterer with butter therein in the refrigerator.

OBJECTS AND ADVANTAGES OF THE INVENTION

Therefore, the objects of the present invention are: to provide a butterer that allows a user to easily and conveniently apply melted butter under control to hot corn on the cob while protecting the user from direct contact with the butter; to provide such a butterer having a body that is shaped to conveniently conform to the hand of the user; to provide such a butterer that is easily disassembled for cleaning; to provide such a butterer that has self contained and removable dispensers for salt and pepper, so as to allow a user to easily prepare corn for eating using a single device; to provide such a butterer having a pusher for allowing a user to convey the butter along an interior channel of the body without directly contacting the butter; to provide such a butterer having a grill that separates the butter from the corn and resists direct contact of semisolid butter with the corn so that the stick of butter does not become contaminated by the corn, but rather allows melted liquid butter through the grill to the corn; to provide such a butterer with a stand and storage tray that receives a lower end of the butterer during non use to prevent drippings of butter therefrom onto the table or the like and that allows the butterer with butter therein to be stored in the refrigerator; and to provide such a butterer that is easy to use, relatively inexpensive to produce and especially well suited for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
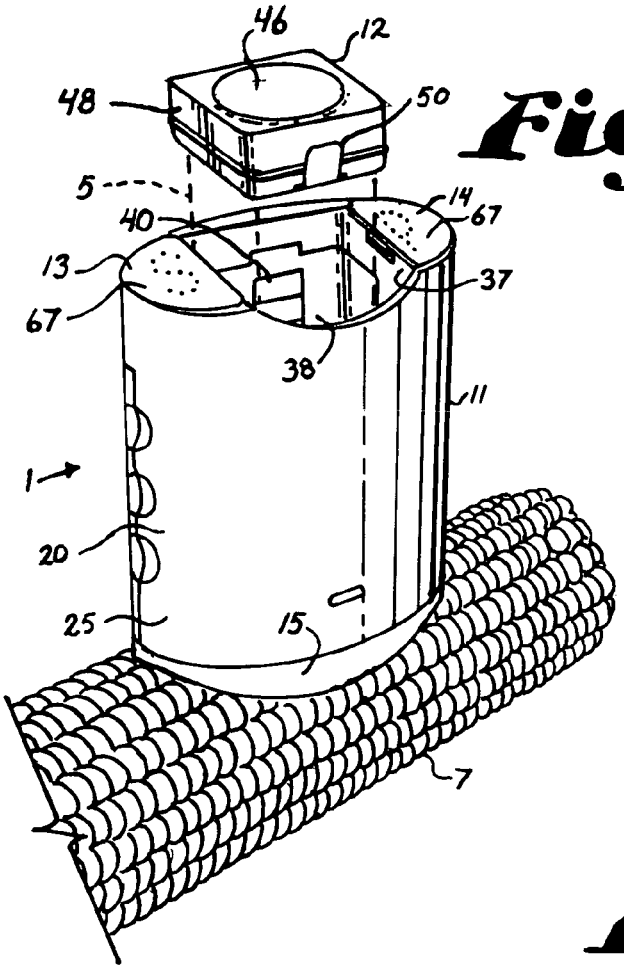
FIG. 1 is a perspective view of a corn butterer in accordance with the present invention, also including a stick of butter shown in phantom and a fragmentary ear of corn.
Figure 2:
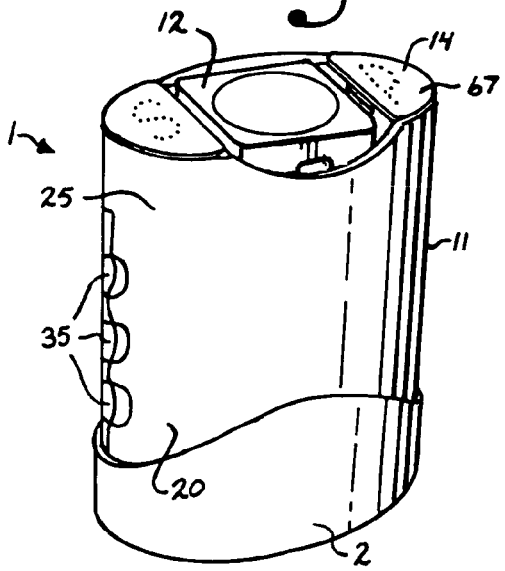
FIG. 2 is a perspective view of the butterer nested in a storage tray.
Figure 4:
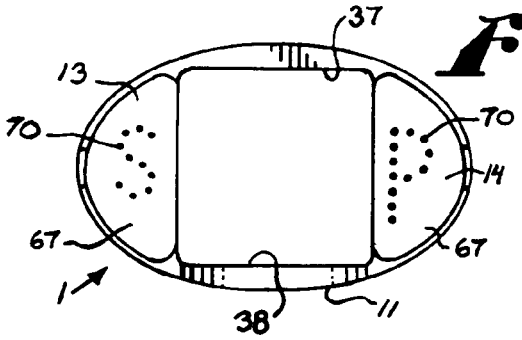
FIG. 4 is a top plan view of the butterer.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally represents a corn on the cob butterer and a mating support and storage tray 2. The butterer 1 is used in conjunction with a conventional stick of butter 5 by a user 6 to butter an ear of corn 7.

The corn butterer 1 has a body 11, a tamper or pusher 12, a salt shaker 13, a pepper shaker 14 and a lower grill structure 15.

Figure 3:
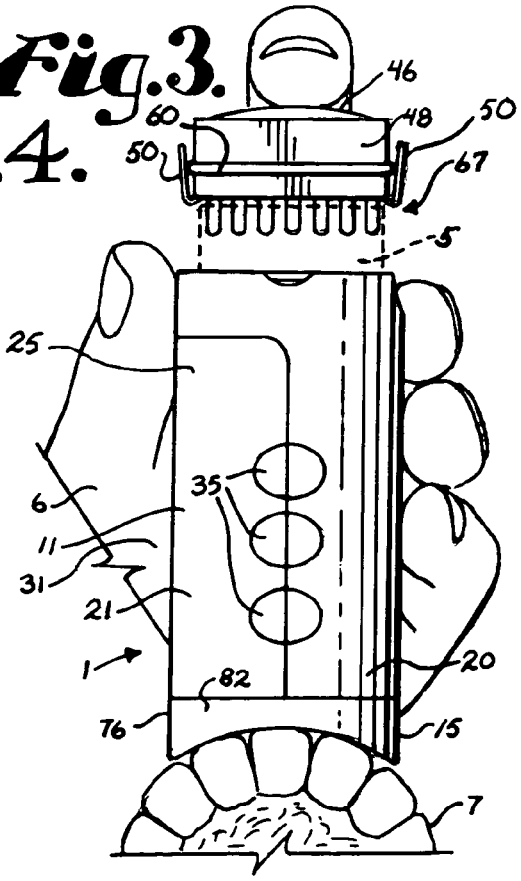
FIG. 3 is a side elevational view of the butterer illustrated in the hand of a user and showing butter in phantom and an ear of corn to which butter is being applied.
Figure 5:
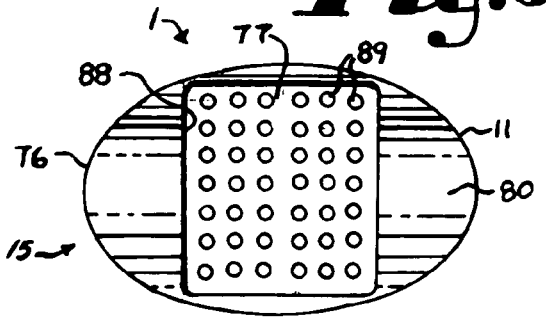
FIG. 5 is a bottom plan view of the butterer with the tray removed.
Figure 6:
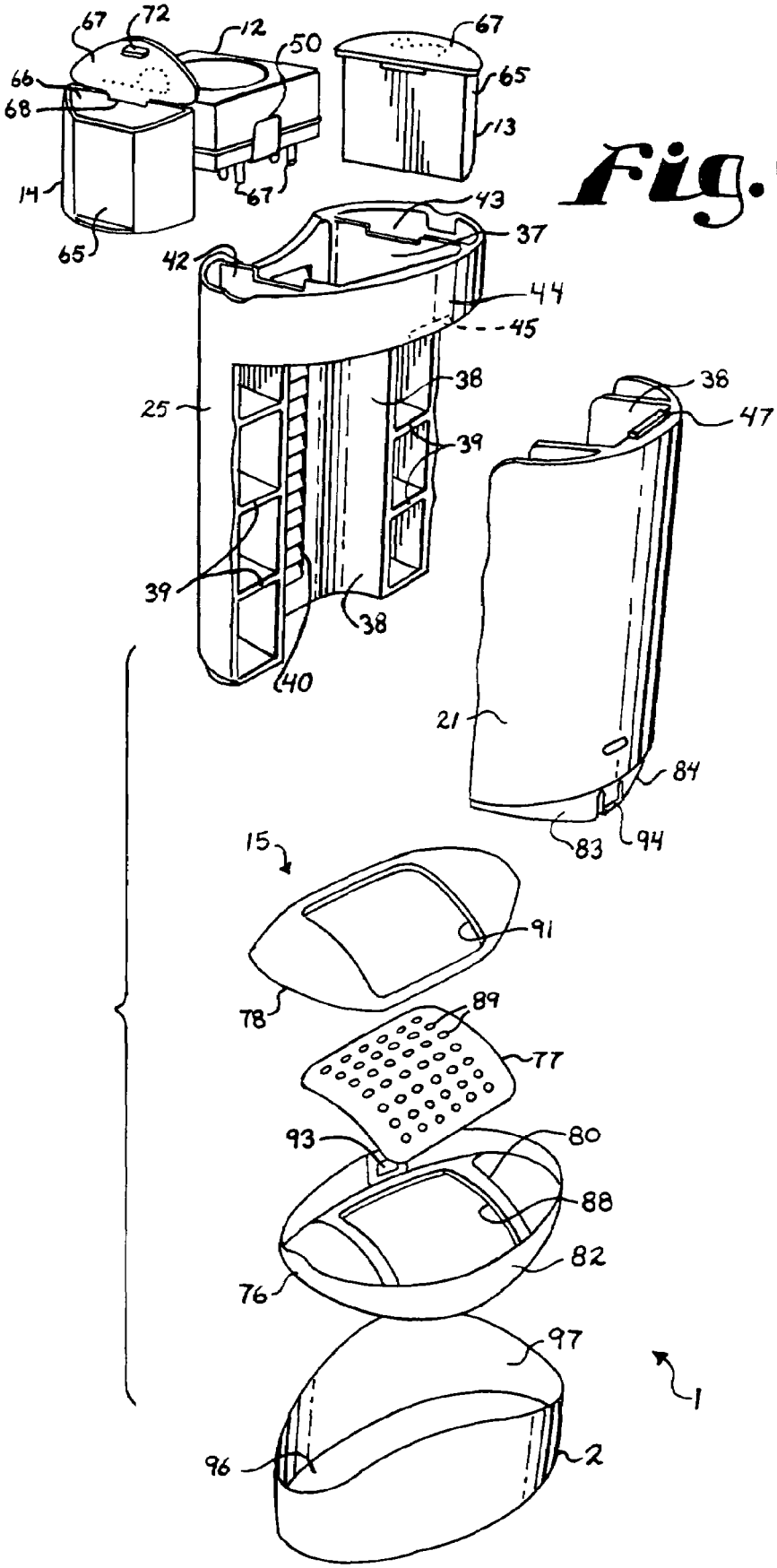
FIG. 6 is a perspective exploded view of the butterer and tray.

The body 12 is constructed in two mateable sections 20 and 21, as can be seen in FIG. 6. The two sections 20 and 21 when disassembled allow the cleaning of the interior of the body 11. The body sections 20 and 21 assembly to an operable carrier for the butter 5 that has an outer grippable wall 25. The wall 25 is sized and shaped to be easily received in the hand 30 of a user 6, as is seen in FIG. 3. A series of finger receiving grips 35 are found on opposite ends of the body 11, as seen in FIG. 3. The wall 25 has an ovate horizontal exterior cross section. As used herein, the terms horizontal, upper, top, lower, bottom and the like apply to the butterer 1 as shown in FIG. 3; however, it is seen that the butterer 1 can be held in other orientations, especially when using the salt shaker 13 and pepper shaker 14.

The body 11 also includes a central vertical channel 37 formed by an interior wall 38 that is generally square in horizontal cross section and sized and shaped to slidably receive the stick of butter 5 which is of standard size as sold in the United States. A series of support struts or elements 39 extends between the exterior wall 25 and the interior wall 38.

Vertically spaced along opposed sides of the interior wall are a series of first resistance structures having pawl or tongue receiving notches 40. Located at the upper ends and on opposite sides of the channel 37 are a pair of substantially semi circular shaped receivers 42 and 43.

The first body section 20 includes an upper portion 44 that extends over the second section 21 when joined.

The section 20 has a receiver 45 and the lower section 21 has a tang or tongue 47 that is snugly received in the receiver 45 when the sections 20 and 21 are joined, so as to frictionally and mechanically help hold the sections 20 and 21 together. The sections 20 and 21 are easily separated by a user by pulling the sections 20 and 21 apart for removing excess butter 5 and cleaning.

The pusher 12 is a generally square shaped structure with a finger receiving dome 46 on the top thereof. The pusher 12 is sized and shaped to snugly but slidingly be received in the channel 37. The pusher 12 includes four faces 48 that face the interior wall 37 when located therein. A pair of opposed faces 48 has second resistance structures including a flexible pawl like tongue 50 that is sized and shaped to be interferingly received in the notches 40 and pointed such that the tongues flexibly ratchet or swing inward to move the next lower notch 40 when downward pressure is applied to the pusher 12 by a user 6, but strongly resist upward movement.

When the pusher 12 is located in the channel 37, the notches 40 are sized, shaped and positioned to frictionally receive the tongues 50, as the pusher 12 is slid or pushed down the channel 37 by the user 6. The engagement of the tongues 50 and notches 40 operably function to interfere with the undesired falling of the pusher 12 from the channel 37. It is foreseen that a series of vertically spaced ribs in the channel 37 and mating ribs on the pusher 12 could be utilized to interferingly engage and thereby provide resistance against accidental discharge of the pusher 12 from the channel 37. Preferably, the tamper 12 also includes a seal 60 that passes around the faces 48 to seal with the channel 37 and help prevent melted butter from flowing up the channel 37 past the pusher 12. Located on the bottom of the pusher 12 are a series of butter engaging spikes or pegs 67.

The salt shaker 13 and pepper shaker 14 each have a substantially semi circular body 65 that forms a container 66 for the salt and pepper. The shaker bodies 65 are removable but snugly frictionally received in the receivers 42 and 43. The shakers 13 and 14 also each include a lid 67 connected by a hinge 68 to the body 65. Each of the lids 67 include a series of small apertures or openings 70 configured in the shape of an S and P respectively through which the salt and pepper can be discharged. The lids 67 also include a frictional latch 72 for securing the lid 67 to a respective body 65. It is foreseen that a further or second solid lid could be hinged to the body 65 also used over each of the lids 67 to prevent discharge of the salt and pepper at an undesired time.

The grill structure 15 includes a lower end keeper or cap 76, a grill 77 and a grill retainer 78. The cap 76 has a lower or bottom wall 80 that is concave and curved to fit the contour of the ear of corn 7, as is shown in FIG. 3. The cap 76 also has an upstanding side wall 82 that surrounds the bottom wall 80 and sticks upwardly from a periphery thereof. The upstanding side wall 82 is sized and shaped to be snugly received in a recess 83 in a bottom end 84 of the body 12.

The cap bottom wall 80 has a centrally located pass through window 88. Received over the window 88 and extending over a portion of the cap bottom wall 80 on all sides of the window 88 is the grill 77. The grill 77 is constructed preferably of a high heat transfer metal such as stainless steel and is generally thin and curved so as to conform to the shape of the bottom wall 80 and the ear of corn 7. The grill 77 is a solid sheet with a plurality of pass through apertures or openings 89 in a field sized and shaped to allow passage of liquid butter therethrough, but to resist flow of semisolid butter. The retainer 78 is positioned over the grill 77 and shaped to conform to the cap bottom wall 80 with a pass through window 91. Located in the cap side wall 82 is a receiver 93 sized and shaped to receive a resistance flexible tongue 94 located along the body recess 83 that, when the butterer 1 is assembled, interferingly resists disassembly of the cap 76 from the body section 20 and 21 as well as separation of the body section 20 and 21, but which can be easily overcome and removed by application of pressure by a user.

The tray 2 functions as a receiver for supporting the butterer 1 when not in use at the table and further for storing the butterer 1 with butter 5 therein in a refrigerator between corn eating meals. The tray 2 includes a flat lower or bottom wall 96 and an upstanding side wall 97 around the periphery of the bottom wall 96. The side wall is sized to slidingly but snugly receive the lower portion of the butterer external wall 25 therein.

The butterer 1 is used by placing a stick or partial stick of butter 5 in the channel 37 and covering same by the pusher 12.

The grill 77 is placed over the corn 7 and heated thereby, such that the butter 5 partly melts and flows through the grill 77 onto the corn 7.

It is to be understood that while certain forms of the present invention have been illustrated and described herein, it is not to be limited to the specific forms or arrangement of parts described and shown.

What is claimed and desired to be secured by Letters Patent is as follows:

1. A corn butterer comprising:

a) a body sized and shaped to be received in the palm of a hand of a user during use;

b) a central axial pass-through channel located in said body, said channel having top and bottom ends and being adapted to slidingly receive a stick of butter therein from the top end thereof;

c) said body including at least one condiment dispenser receiver located adjacent to said channel top end;

d) a removable condiment dispenser interferingly received in said condiment dispenser receiver;

e) a substantially thin metal grill removably connected to said body so as to be positioned over the channel bottom end so as to prevent the passage of non-liquid butter from the channel bottom end and so as to be further positioned so as to contact an ear of corn during use; and f) a storage tray for receiving and storing the butterer body during non-use, whereby unused butter remaining in the channel is stored.

2. The butterer according to claim 1 wherein:

a) said body is ovate in horizontal cross section and has first and second sections interferingly held together during use; said body sections being separable to allow cleaning of said channel.

3. The butterer according to claim 2 wherein:

a) said first section includes a wrap around upper end with a receiver therein; and b) said second section includes a tongue for seating in said receiver.

4. The butterer according to claim 1 wherein:

a) said body includes a series of finger receiving depressions on at least one side thereof.

5. The butterer according to claim 1 including:

a) a pusher that is sized and shaped to be slidingly received in said channel and adapted to be pushed by a user therethrough so as to be adapted to urge butter in the channel toward said grill.

6. The butterer according to claim 5 wherein:

a) said pusher includes a field of butter engaging pegs on a lower end thereof.

7. The butterer according to claim 5 wherein:

a) said body includes a series of first spaced resistance structure notches along at least one side of said channel; and b) said pusher includes at least one second resistance structure pawl along one side thereof that is aligned to interferingly engage the notches in said channel as said pusher is urged through said channel, so as to reduce the likelihood of said pusher inadvertently falling from said channel.

8. The butterer according to claim 5 wherein:

a) said pusher includes a seal around the sides thereof that is sized and shaped to seal between the pusher and the channel during usage.

9. The butterer according to claim 1 wherein:

a) said dispenser includes a hinged lid with apertures therein.

10. The butterer according to claim 1 wherein:

a) said dispenser is a first dispenser and including a second dispenser located in said body opposite said first dispenser at the top end of said channel wherein said first dispenser is adapted for salt and said second dispenser is adapted for pepper.

11. The butterer according to claim 1 wherein:

a) said grill has a concave plate that is sized and shaped to be adapted to be located upon an ear of corn and said plate has a pattern of apertures therein sized and positioned to allow passage of liquid butter but to prevent passage of semisolid butter.

12. The butterer according to claim 1 wherein:

a) said grill is constructed of a stainless steel metal.

13. The butterer according to claim 1 including:

a) a grill support structure.

14. The butterer according to claim 13 wherein:

a) said support structure includes an open lower window that operably receives said grill thereon; and b) an integral ring sized and shaped to be received around a lower end of said body.

15. The butterer according to claim 14 wherein:

a) said support structure ring operably mates with and secures together lower ends of said body first and second sections.

16. The butterer according to claim 15 wherein:

a) said support structure ring and said body each include a portion of an interference fit keeper that resists removal of the ring from the body, but which can be overcome to remove said ring from said body by application of pressure by a user.

17. The butterer according to claim 1 wherein:

a) said tray includes a generally flat bottom wall and with a surrounding upstanding side wall that is sized and shaped to snugly but slidingly receive a lower end of the body therein.

* * * * *